US005732536A

United States Patent [19]

Lin et al.

[11] Patent Number: 5,732,536

[45] Date of Patent: Mar. 31, 1998

[54] TAPE ROLL IN-SERIES PACKAGE MACHINE

[75] Inventors: Ching-Lin Lin, Hsinchu; Chia-Hung Huang, Taipei; Do-Yu Lee, Hsinchu, all of Taiwan

[73] Assignee: Industrial Technology Research Institute, Hsinchu, Taiwan

[21] Appl. No.: 739,072

[22] Filed: Oct. 28, 1996

[51] Int. Cl.[6] ..... B65B 35/30

[52] U.S. Cl. ..... 53/535; 53/245; 53/247; 53/537; 53/540

[58] Field of Search ..... 53/245, 247, 535, 53/537, 538, 540, 566

[56] References Cited

U.S. PATENT DOCUMENTS

| | | | |
|---|---|---|---|
| 1,942,555 | 1/1934 | Kimball et al. | 53/535 X |
| 3,434,603 | 3/1969 | Horman | 53/245 X |
| 3,594,977 | 7/1971 | Grasvoll | 53/245 X |
| 4,608,808 | 9/1986 | Ryan et al. | 53/245 X |
| 4,633,653 | 1/1987 | Roberts et al. | 53/245 X |
| 4,679,379 | 7/1987 | Cassoli | 53/540 X |
| 5,339,606 | 8/1994 | Benz | 53/537 |

*Primary Examiner*—Daniel Moon
*Attorney, Agent, or Firm*—W. Wayne Liauh

[57] ABSTRACT

A tape roll in-series package machine for neatly packing a plurality of tape rolls into a paper box. In includes (a) a conveying device, (b) an in-series filling device, and (c) a paper box elevating device. The in-series filling device contains first, second, and third pneumatic cylinder each of which is connected to a receiving plate to cooperatively pack a row of the tape rolls into a paper box. The paper elevating device contains (i) a paper box conveyor which is divided into front section, middle and rear sections, each of the sections is driven by a separate mechanism; (ii) an elevating frame disposed above the middle section of the paper box conveyor, wherein the elevating frame contains a pair of fending plates each being driven by a revolving pneumatic cylinder for holding the paper box in place and facilitating the incoming and outgoing motions of the paper box; and (iii) a Z-axis stepping motor which is provided to control an up-and-down motion of the elevating frame so as to adjust a vertical position of the paper box.

9 Claims, 9 Drawing Sheets

TAPE ROLL IN-SERIES PACKAGE MACHINE

FIELD OF INVENTION

The present invention is a Tape Roll In-series Package Machine making use of a multiset of pneumatic cylinders in accommodating with the z-axis elevating technique to accomplish the automatic package function of a plurality of pipe-shaped in-series tape rolls which are used for strapping boxes.

BACKGROUND OF THE INVENTION

In general, the package procedures of tape rolls of prior art are all using human labor to fill the tape rolls into paper box, neatly arrange them in the box and then strap the box. It takes lot of time and efforts in this way of human labor handling, therefore, to aim at the above-mentioned shortcomings, the inventor actively undertakes research and development to perform creative and improving works expecting to improve the conventional disadvantages of manual box filling works.

SUMMARY OF THE INVENTION

The main object of the present invention is to provide a Tape Roll In-series Package Machine making use of a multiset of pneumatic cylinders in accommodating with the z-axis elevating technique of Stepping Motor to accomplish the automatic package operation in order to reduce human labor and enhance working efficiency.

The next object of the present invention is to disclose a Tape Roll In-series Package Machine by adjusting the location of pneumatic cylinders or width of tape roll receiving plate to facilitate the use of tape roll in different size in order to meet the requirements on the market.

The another object of the present invention is to expose a tape roll in-series package machine making use of the elevating technique of the z-axis stepping motor to enable tape rolls to fill layer by layer into paper box.

For these reasons and in order to disclose the objects, characteristics and efficacy of the present invention, the author herewith presents a detailed and clear illustration together with the accompanied drawings:

BRIEF DESCRIPTION OF THE DRAWINGS AND THEIR COMPONENT NUMBERS (A) The Drawings FIG. 1A is a schematic diagram of conveying device part of the structure of the present invention.

(B) The Component Numbers

| | | | |
|---|---|---|---|
| 10 | Conveying Device | 241 | Fending Plate |
| 11 | Conveyer | 30 | Elevating Device |
| 12 | Pneumatic Cylinder | 301 | Elevating Frame |
| 121 | Connecting Rod | 31 | Z-axis Stepping Motor |
| 13 | One-way Bearing | 32 | Revolving Pneumatic Cylinder |
| 14 | Pneumatic Cylinder | 321 | Sensor |
| 141 | Sensor | 322 | Fending Plate |
| 15 | Pneumatic Cylinder | 33 | Revolving Pneumatic Cylinder |
| 151 | Sensor | 331 | Sensor |
| 20 | In-series Filling Device | 332 | Fending Plate |
| 21 | First Pneumatic Cylinder | 34 | Paper Box Conveyer |
| 211 | Receiving Plate I | 341 | Conveyer |
| 212 | Sensor | 342 | Conveyer |
| 22 | Second Pneumatic Cylinder | 40 | Paper Box |
| 221 | Receiving Plate II | 401 | Folded Plate |
| 23 | Third Pneumatic Cylinder | 41 | Tape Roll |
| 231 | Receiving Plate III | | |
| 24 | Pneumatic Cylinder | | |

DETAILED DESCRIPTION OF THE INVENTION

Figure 1B:
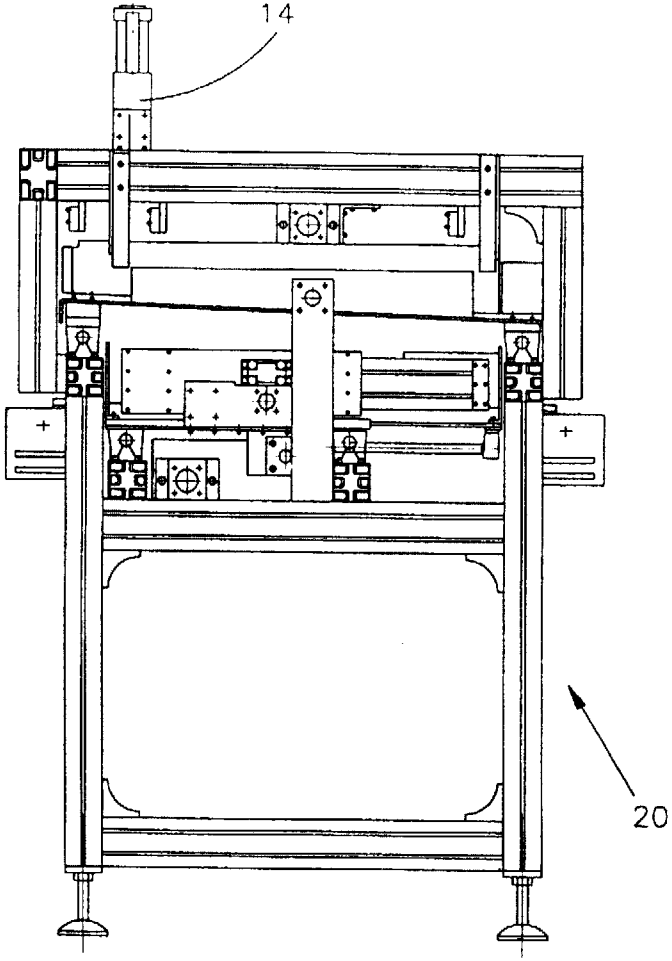
FIG. 1B is a schematic diagram of in-series filling device part of the structure of the present invention.
Figure 1A:
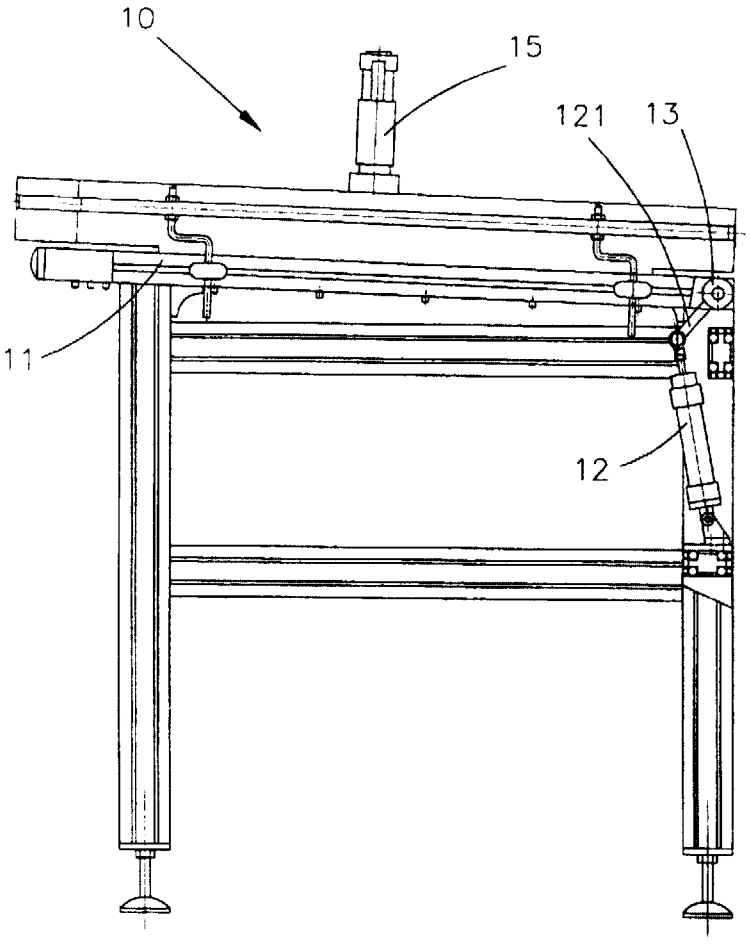
Figure 2:
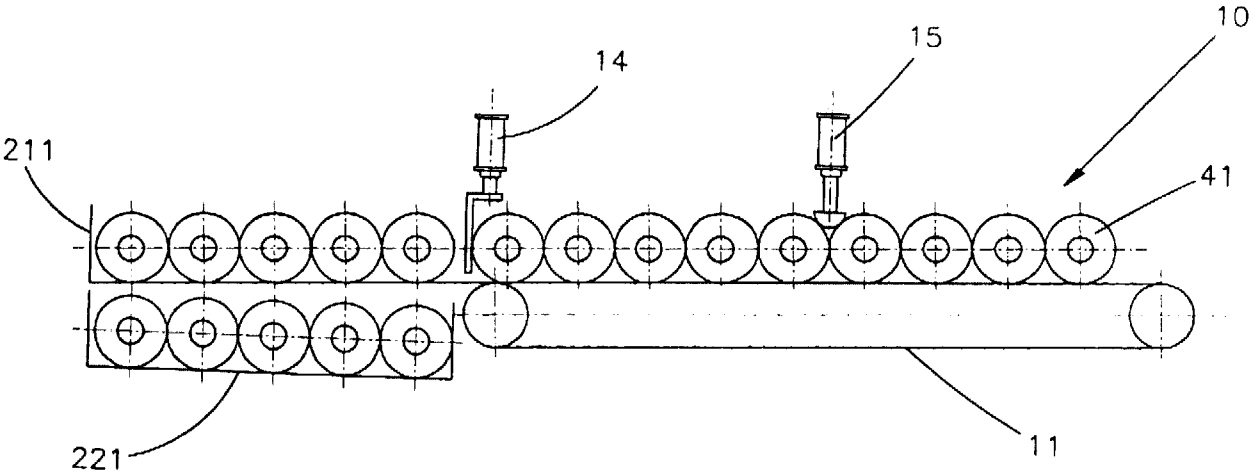
FIG. 2 is the diagram showing the connecting relationship between the conveying device and the receiving plate of the present invention.
Figure 3B:
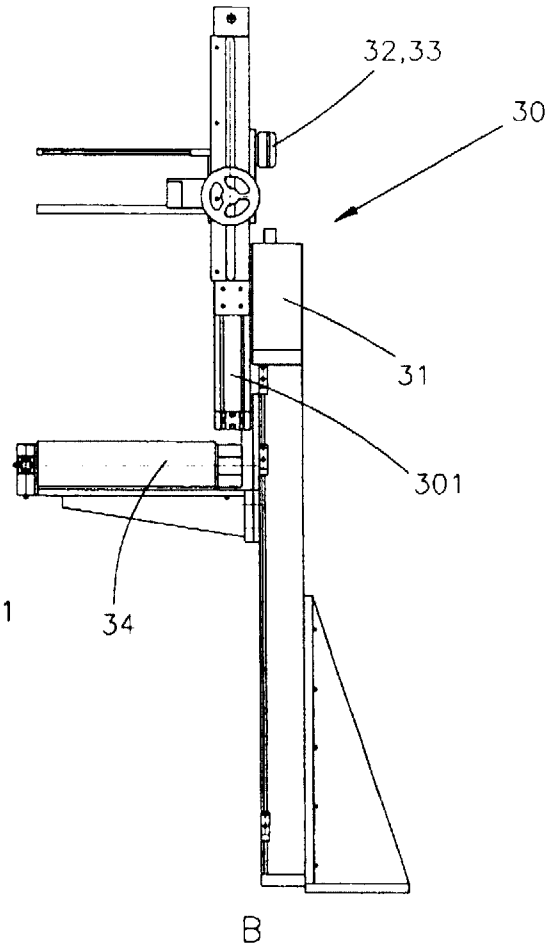
FIG. 3B is the side view of the elevating device of the present invention.
Figure 3A:
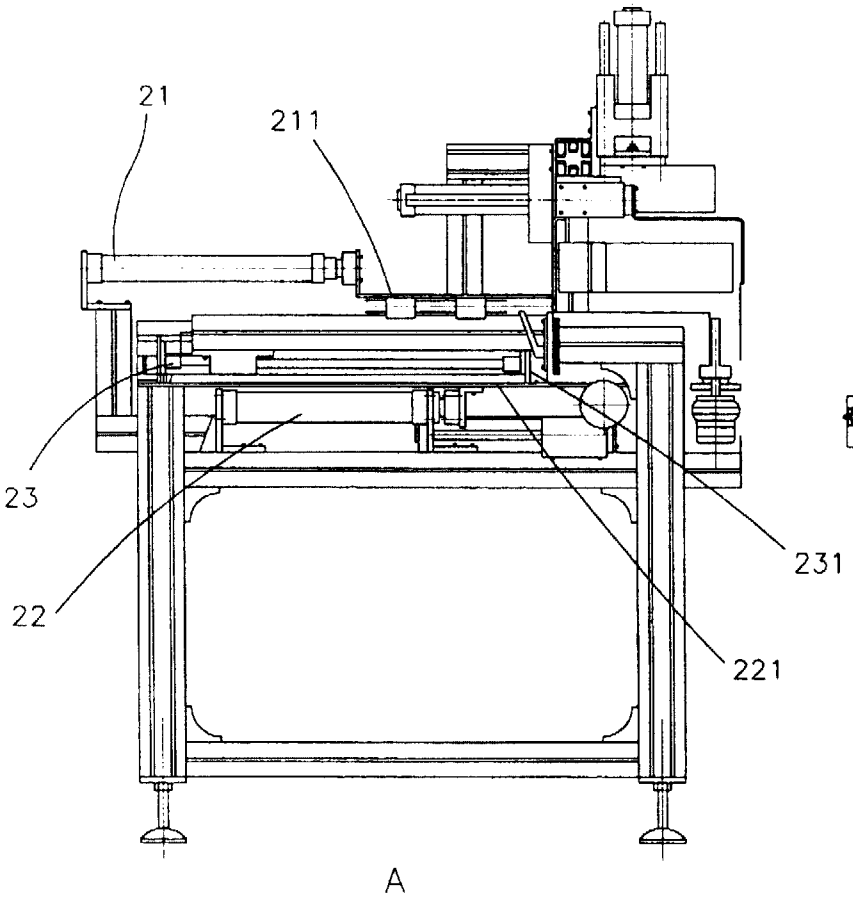
FIG. 3A is the side view of the in-series filling device of the present invention.

The schematic diagram of a part of the structure of the present invention shown in FIG. 1 comprises a Conveying Device 10 and an In-series Filling Device 20, its main function is to convey automatically the pipe-shaped goods and to fill them into boxes where the Conveyer Device 10 is provided with a Conveyer 11 which shows a design with inclined plane and there is a Pneumatic Cylinder 12 provided at an appropriate place at the bottom of its terminal and there is a Connecting Rod 121 connected to an end of the Pneumatic Cylinder 12 while the other end of the connecting rod is connected to an one-way bearing 13 that is provided on the taming shaft of the Conveyer 11 in order that the Conveyer 11 can perform only an one-way conveyance; the terminal of the Conveyer I 1 is connected to the In-series Filling Device 20 and there is a Pneumatic Cylinder 14 and a Pneumatic Cylinder 15 (as shown in FIG. 2) provided at the middle section of its top as well as at the intersection of its terminal and the In-series Filling Device 20 respectively in order to set the number of goods each time it conveys, among them the goods are tape rolls in the embodiments of the present invention; referring also to FIG. 3A, it is the side view of the in-series filling device of the present invention where on the In-series Filling Device 20 is provided with a multiset of pneumatic cylinders where one end of the First Pneumatic Cylinder 21 is connected to a Receiving Plate I 211 which is extended to the terminal of the Conveyer 11 as mentioned above and is shown as an inclined plane in order to receive goods sent from the Conveyer 11; as the goods is positioned on the Receiving Plate I 211, the first Pneumatic Cylinder 21 will then activate backward in order to enable the goods on the Receiving Plate I 211 to drop on the Receiving Plate II 221 following the trend, where the Receiving Plate II 221 is connected to one end of the second Pneumatic Cylinder 22, thereby, by means of its activation, to push the Receiving Plate 221 toward the Elevating Device 30, thereafter, to enable the Receiving Plate III 231 at its front end to push forward through the activation of the Third Pneumatic Cylinder 23 where the Receiving Plate III 231 is set up above the Receiving Plate II 221 and is in a status perpendicular to it, accordingly, it can smoothly pushes the goods on the Receiving Plate 221 toward the location where the Elevating Device 30 is located through the push-out of the Receiving Plate III 231.

Figure 4:
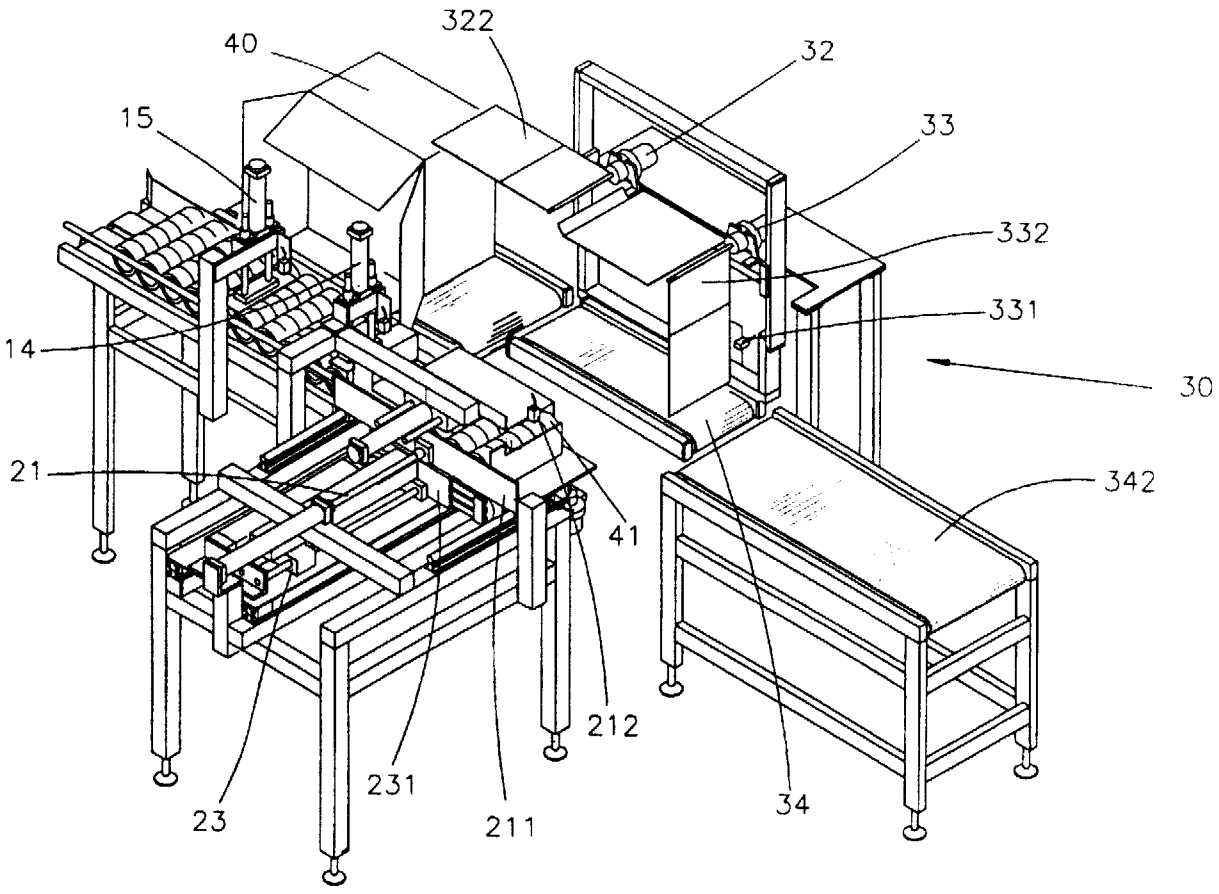
FIG. 4 is the isometric drawing of the overall appearance of the present invention.

FIG. 3B is the side view of the Elevating Device 30 of the present invention where the Elevating Device 30 comprises an Elevating Frame 301 with a Z-axis Stepping Motor 31 provided at an appropriate location at its rear side in order to enable it to perform up-and-down action; also there are a from and a rear Revolving Pneumatic Cylinders 32, 33 and a from and a rear sensors 322, 332 provided at each side of the Elevating Frame 301 on its top where fending plates 322, 332 (as shown in FIG. 4) are connected to the front ends at each of the front and rear Revolving Pneumatic Cylinders 32, 33 respectively and the interval between the two Fending Plates 322, 332 can exactly contain a Paper Box 40, and there are Paper Box Conveyers 34 set up which are connected to the bottom of the Elevating Frame 301 with Conveyers 341, 342 extended to and connected to it to enable the Paper Box 40 to be conveyed into the Elevating Device 30, at this moment, through the detection of the Sensor 321, the Revolving Pneumatic Cylinder 32 will be activated and let the Fending Plate 322 at its end turns outward to open to facilitate the Paper Box 40 to enter into the Conveyer 34 of the Elevating Frame 301; in the mean time, the Pneumatic Cylinders 14, 15 above the Conveying Device 10 are all moving upward to facilitate the Tape Rolls 41 to enter in order to complete the In-series Action of the first stage (the in-series number of Tape Rolls 41 can be changed by adjusting the location of the Pneumatic Cylinder 15); since the two Pneumatic Cylinders 14, 15 are moving upward, owing to the gravitational force, the Tape Rolls 41 will roll into and place on the Receiving Plate I 211 of the In-series Filling Device 20 until the number of Tape Rolls 41 reach a preset value, then the Pneumatic Cylinder 14 will move downward in order to stop the Tape Rolls 41 on the Conveying Device 10 from entering into the Receiving Plate I 211; in the mean time, the Sensors 212 on both sides of the Receiving Plate I 211 can further ascertain the number of Tape Rolls 41 received on the plate to complete the in-series action of the second stage.

Figure 5:
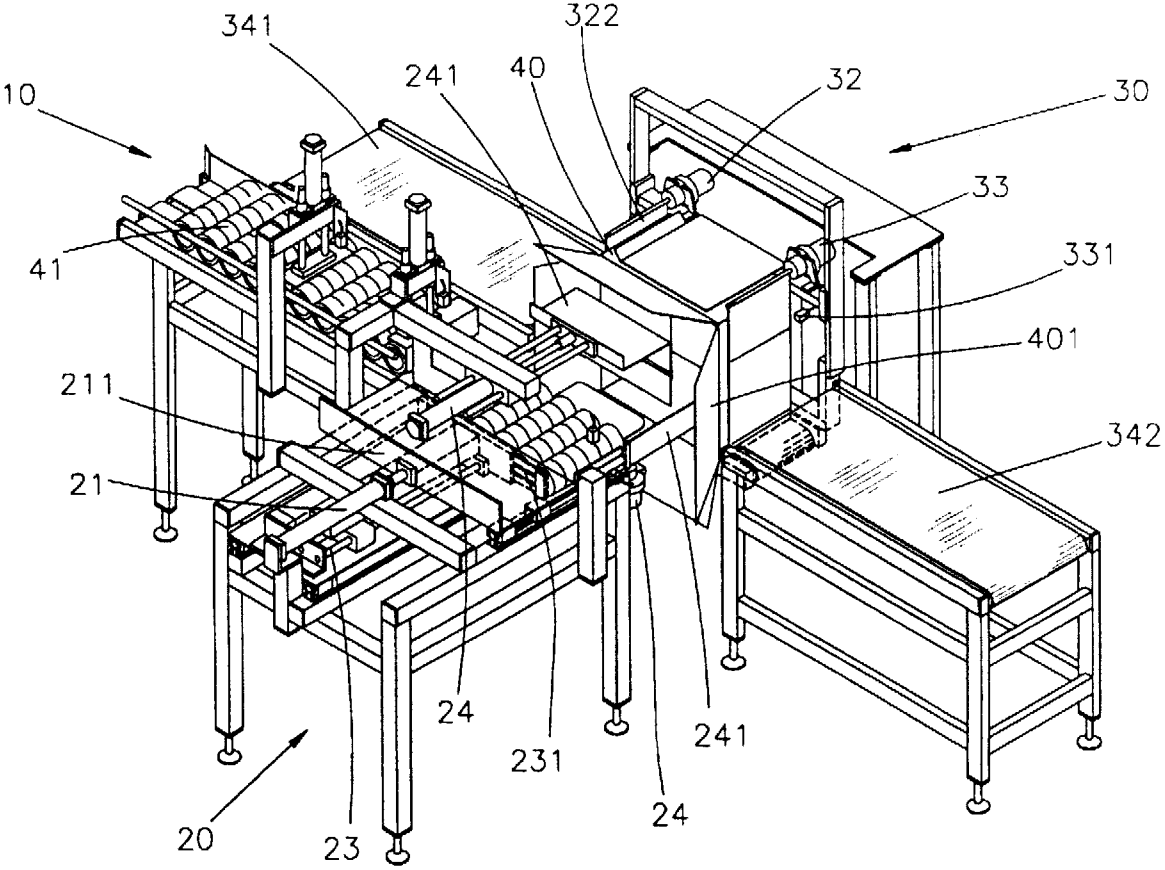
FIG. 5 is the schematic motion diagram I of the present invention.

Referring to the schematic diagram I of the present invention shown in FIG. 5 and comparing with the ones shown in FIG. 3, as the Paper Box 40 enter the Elevating Device 30 following the conveyance of the Paper Box Conveyer 34, the Revolving Pneumatic Cylinder 32 will be activated to position the Paper Box 40 at a positioned point between the two Fending Plates 322, 332 to be ready for the filling action. A set of Pneumatic Cylinders 24, with their ends connected with a Fending Plate 241, are provided at the In-series Filling Device 20 corresponding to the four comers of the Paper Box 40's opening. Through the activation of the Pneumatic Cylinders 24, the four Folded Plate 401 of the Paper Box 40 will open outward to facilitate the filling work. At this moment, the First Pneumatic Cylinder 21 is also activated to let the Receiving Plate I 211 pull back to make the Tape Rolls 41 on it drop to the Receiving Plate II 221 (as shown in FIG. 6A) due to the gravitational force.

Figure 6A:
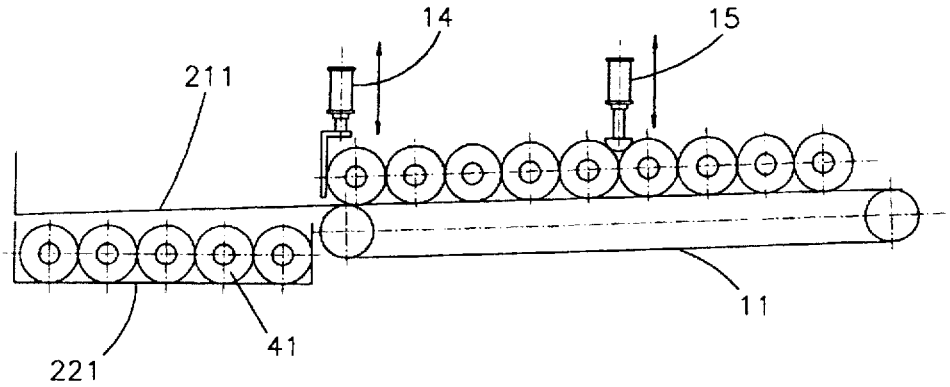
FIG. 6A is the schematic motion diagram II of the present invention showing the movement of tape rolls between the first receiving plate and the second receiving plate.
Figure 6B:
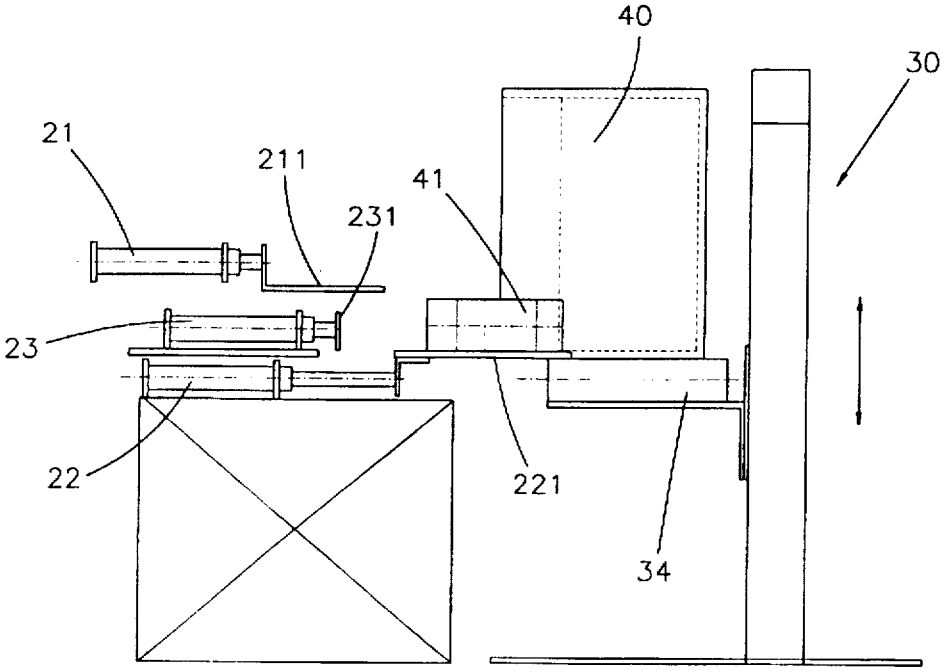
FIG. 6B is the schematic motion diagram II of the present invention showing the movement of first, second, and third pneumatic cylinders.
Figure 7A:
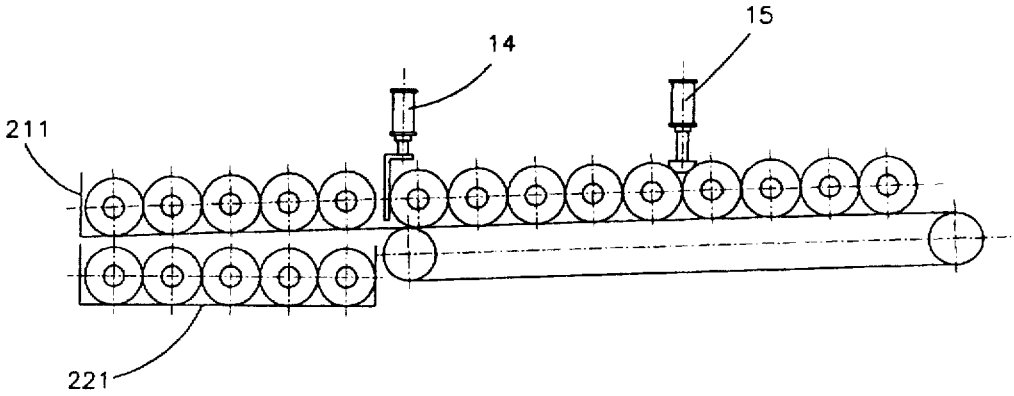
FIG. 7A is the schematic motion diagram III of the present invention showing the movement of tape rolls between the first receiving plate and the second receiving plate, after the elevating frame is lowered by one tape roll diameter.
Figure 7B:
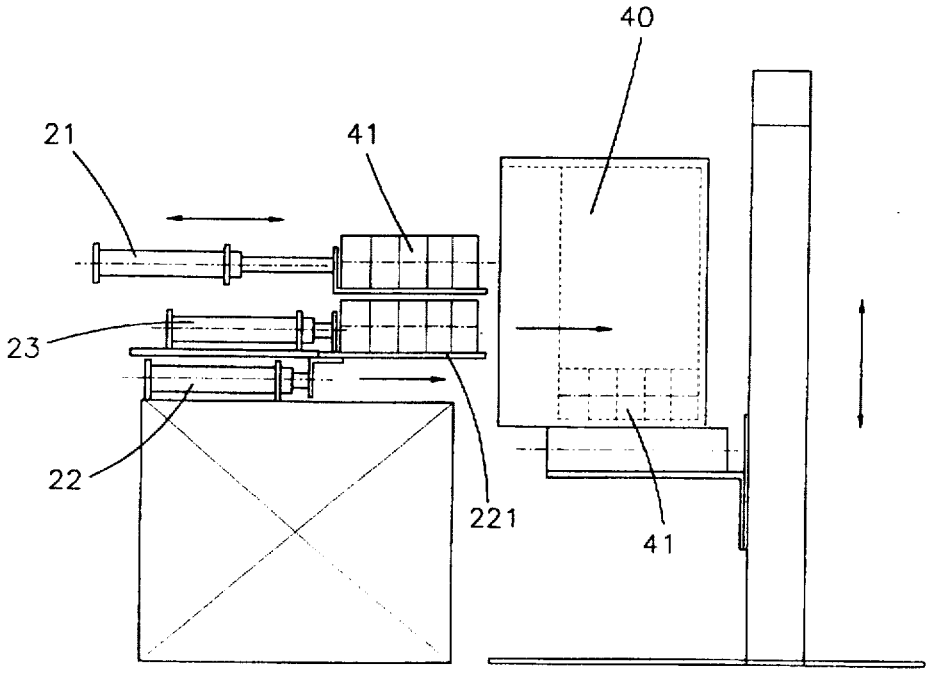
FIG. 7B is the schematic motion diagram II of the structure of the present invention showing the movement of first, second, and third pneumatic cylinders, after the elevating frame is lowered by one tape roll diameter.
Figure 8:
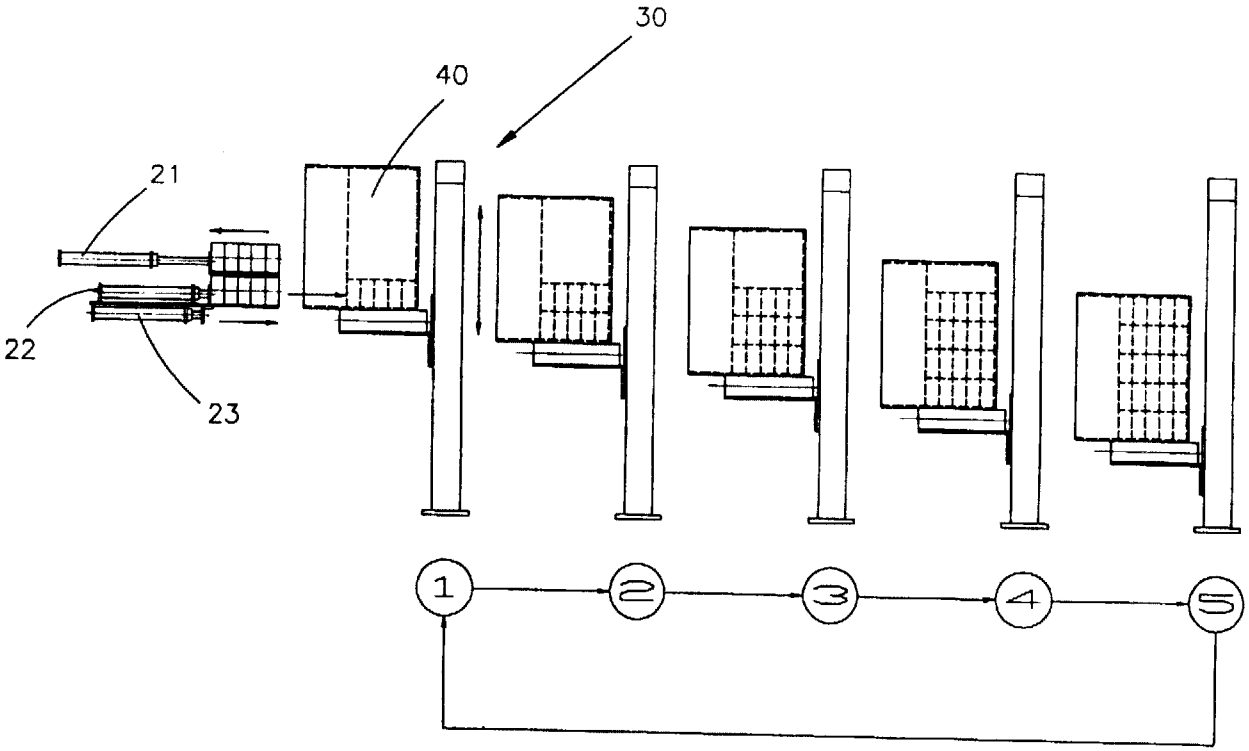
FIG. 8 is the filling operation flow charts of the present invention.
Figure 9:
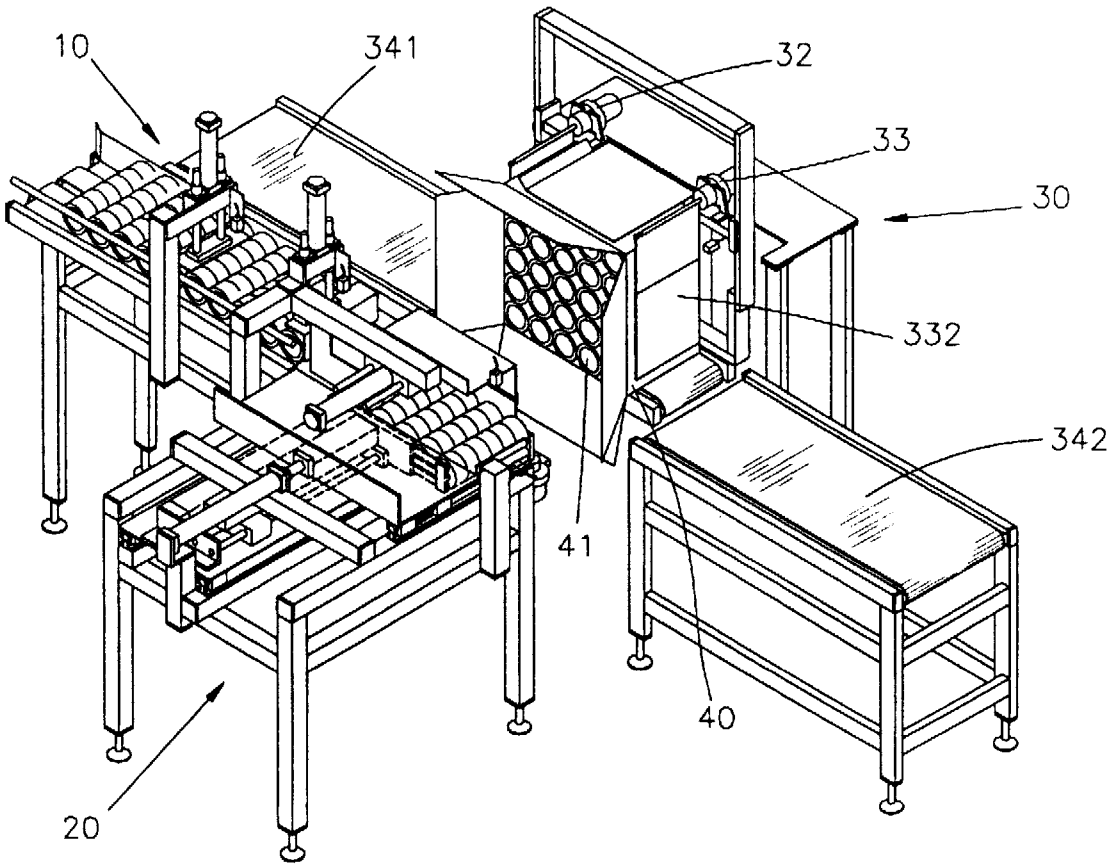
FIG. 9 is the status of finishing a Package operation of the present invention.

Referring to the schematic motion diagram II of the present invention as shown in FIGS. 6A and 6B, as the Paper Box 40 is positioned and after the four sets of Pneumatic Cylinder 24 are activated to push out to open the four Folded Plates 401 of the Paper Box 40, the Second Pneumatic Cylinder 22 is activated to push the Receiving Plate II 221 and the Tape Rolls 41 on it toward the Paper Box 40's opening, thereafter, the Third Pneumatic Cylinder 23 is activated to let the Receiving Plate III 231 push the Tape Rolls 41 on the Receiving Plate II 221 into the Paper Box 40; referring again to FIGS. 7A and 7B, after the first layer of Tape Rolls 41 are pushed into the Paper Box 40, the Elevating Device 30 will lower a distance equivalent to the outside diameter of a Tape Roll 41 to facilitate the next filling work; FIG. 8 shows the flow chart of the filling action of the present invention, repeating the foregoing action the Tape Rolls 41 are neatly filled into the Paper Box 40 layer by layer till the Paper Box 40 is full of Tape Rolls 40, the Elevating Frame 301 will then be raised back to the original location (as shown in FIG. 9) and after it is positioned, the Revolving Pneumatic Cylinder 33 will be activated to make the Fending Plate 332 swing outward in order to let the Paper Box 40, which is full of Tape Rolls 41, leave the filling zone through the conveyance of the Paper Box Conveyer 34 and advance to the next operating procedure so as to complete the tape roll in-series filling action.

Summarizing the above-mentioned statement, it is known that the "Tape Roll In-series Package Machine" of the present invention is really practical and original, and is applicable to various kinds of package mode such as 5*5, 5*4, 4*3 etc. to fulfill the object of flexibility on the specification and size of tape rolls and their package modes, it is further applicable to the package function of any goods in cylindrical configuration.

Although the present invention has been illustrated and described previously with reference to the preferred embodiments thereof, it should be appreciated that it is in no way limited to the details of such embodiments, but is capable of numerous modification within the scope of the appended claims.

What is claimed is:

1. A Tape Roll In-series Package Machine comprising:

(a) a conveying device, which comprises:

(i) a tape roll conveyer for conveying a plurality of tape rolls to be packaged;

(ii) a conveying pneumatic cylinder and bearing assembly for driving said tape roll conveyer; and (iii) a sensor and a pair of quantifying cylinders disposed above said tape roll conveyor to control the number of tape rolls to be conveyed;

(b) an in-series filling device, which comprises:

(i) a first pneumatic cylinder connected to a horizontally disposed first receiving plate for receiving the tape rolls delivered from said tape roll conveyor;

(ii) a second pneumatic cylinder connected to a horizontally disposed second plate, wherein said second receiving plate is disposed beneath said first receiving plate such that when said first pneumatic cylinder retreats, the tape rolls on said first receiving plate will drop to said second receiving plate;

(iii) a a third pneumatic cylinder connected to a vertically disposed third receiving plate wherein said third receiving plate is disposed slightly above said second receiving plate so as to push the tape rolls sitting on said second receiving plate into a paper box;

(c) a paper box elevating device, which comprises:

(i) a paper box conveyor which is divided into a front section, a middle section arid a rear section, each of said sections being driven by a separate mechanism;

(ii) an elevating frame disposed above said middle section of said paper box conveyor, wherein said elevating frame contains a pair of fending plates each being driven by a revolving pneumatic cylinder for holding the paper box in place and facilitating the incoming and outgoing motions of the paper box;

(iii) a Z-axis stepping motor which is provided to control an up-and-down motion of said elevating frame so as to adjust a vertical position of the paper box;

(d) whereby as the paper box is moved to its predetermined position through said paper box conveyor and said fending plates of said elevating frame, said second pneumatic cylinder will activate to move the tape rolls to an opening of the paper box and subsequently, said third pneumatic cylinder will be activated to cause said third receiving plate to push the tape rolls into the paper box to complete the filling action, thereafter, said stepping motor will lower a distance equivalent to the outside diameter of the tape roll so as to allow a new row of the tape rolls to be placed above the old row of tape rolls.

2. A tape roll in-series package machine according to claim 1 wherein said tape roll conveyor is an inclined one.

3. A tape roll in-series package machine according to claim 1 wherein the number of tape rolls to be conveyed is changed by adjusting a distance between said pair of quantifying cylinders above said tape roll conveyor.

4. A tape roll in-series package machine according to claim 1 which further comprises a one-way bearing which is provided at one end of said tape roll conveyor so as to allow said tape roll conveyor to convey only in one direction.

5. A tape roll in-series package machine according to claim 1 which further comprises four box-opening pneumatic cylinders respectively disposed along four sides of the paper box so as to open the paper box and keep it in a fully opened position.

6. A tape roll in-series package machine according to claim 1 wherein said first receiving plate is level with said tape roll conveyor as if said first receiving plate were an extension of said tape roll conveyor.

7. A tape roll in-series package machine according to claim 1 wherein both sides of said first receiving plate are provided with a sensor to ensure that a correct number of the tape rolls are collected on said first receiving plate.

8. A tape roll in-series package machine according to claim 1 wherein said first pneumatic cylinder is structured such that when it is activated the tape rolls collected on said first receiving plate will drop onto said second receiving plate.

9. A tape roll in-series package machine according to claim 1 wherein said elevating frame further comprises at least a sensor to control an action of said revolving cylinders.

* * * * *